US006155308A

United States Patent [19]

Kuji

[11] Patent Number: 6,155,308

[45] Date of Patent: Dec. 5, 2000

[54] INDUSTRIAL FABRIC

[75] Inventor: Takehito Kuji, Tokyo, Japan

[73] Assignee: Nippon Filcon Co., Ltd., Japan

[21] Appl. No.: 09/157,524

[22] Filed: Sep. 21, 1998

[30] Foreign Application Priority Data

Sep. 19, 1997 [JP] Japan ..... 9-293105

[51] Int. Cl.[7] ..... D03D 11/00; D03D 13/00

[52] U.S. Cl. ..... 139/410; 139/383; 139/408; 139/409; 139/415; 442/203; 442/205; 442/206; 442/207; 156/900; 156/902; 156/903; 428/257

[58] Field of Search ..... 139/383, 408, 139/409, 410, 415; 442/203, 206, 207, 205; 428/257; 156/900, 902, 903

[56] References Cited

U.S. PATENT DOCUMENTS

| | | | |
|---|---|---|---|
| 4,821,780 | 4/1989 | Tate | 139/383 |
| 4,989,648 | 2/1991 | Tate et al. | 139/383 |
| 4,995,428 | 2/1991 | Tate et al. | 139/383 |
| 4,998,569 | 3/1991 | Tate | 139/383 |
| 5,013,330 | 5/1991 | Durkin et al. | 51/297 |
| 5,490,543 | 2/1996 | Fujisawa | 139/383 |
| 5,829,489 | 11/1998 | Kufi | 139/383 |

*Primary Examiner*—Terrel Morris
*Assistant Examiner*—Christopher C. Pratt
*Attorney, Agent, or Firm*—Rader, Fishman & Grauer

[57] ABSTRACT

Thee is provided an industrial single-layer or double-layer fabric which is free from a depression on the surface of an upper layer, has a large number of fiber supporting points, and is excellent in surface smoothness. An industrial double-layer structured fabric is provided having auxiliary wefts in an upper layer fabric, which includes an upper layer fabric woven of upper layer warps and upper layer wefts, a lower layer fabric woven of lower layer warps and lower layer wefts, and connecting yarns for connecting the upper layer fabric and the lower layer fabric, wherein an auxiliary weft passing over two or more adjacent upper layer warps and is woven in and is arranged between upper layer wefts, connecting yarns are arranged on both sides of the auxiliary weft, and respectively, pass over two or more adjacent upper layer warps, and are located above an upper layer warp in a portion where the auxiliary weft is located below the upper layer warp, and one of the binder yarns arranged on both sides goes down and is located below a lower layer warp in a portion where the other binder yarn is located above upper layer warps to form a paper making surface and is located above an upper layer warp in a portion where the other binder yarn is located below the lower layer wrap.

9 Claims, 6 Drawing Sheets

| | 1 | 2 | 3 | 4 | 5 | 6 | 7 | 8 | 9 | 10 |
|---|---|---|---|---|---|---|---|---|---|---|
| 40* | | | × | ○ | × | | | × | ○ | × |
| 39* | □ | | | ▩ | ▩ | | | | | □ |
| 38* | | | | | | ▩ | ▩ | | ▩ | ▩ |
| 37* | ▩ | ▩ | | | □ | □ | | | | |
| 36* | × | ○ | × | | | × | ○ | × | | |
| 35* | | | □ | □ | | | ▩ | ▩ | | |
| 34* | | ▩ | ▩ | | | | | | ▩ | ▩ |
| 33* | | | | ▩ | ▩ | | | □ | □ | |
| 32* | × | | | × | ○ | × | | | × | ○ |
| 31* | ▩ | | | | | □ | □ | | | ▩ |
| 30* | | ▩ | ▩ | | ▩ | ▩ | | | | |
| 29* | □ | □ | | | | | ▩ | ▩ | | |
| 28* | | × | ○ | × | | | × | ○ | × | |
| 27* | | | ▩ | ▩ | | | | | □ | □ |
| 26* | | | | | ▩ | ▩ | | ▩ | ▩ | |
| 25* | ▩ | | | □ | □ | | | | | ▩ |
| 24* | ○ | × | | | × | ○ | × | | | × |
| 23* | | □ | □ | | | ▩ | ▩ | | | |
| 22* | ▩ | ▩ | | | | | | ▩ | ▩ | |
| 21* | | | ▩ | ▩ | | | □ | □ | | |
| 20* | | | × | ○ | × | | | × | ○ | × |
| 19* | | | | | □ | □ | | | ▩ | ▩ |
| 18* | ▩ | ▩ | | ▩ | ▩ | | | | | |
| 17* | □ | | | | | ▩ | ▩ | | | □ |
| 16* | × | ○ | × | | | × | ○ | × | | |
| 15* | | ▩ | ▩ | | | | | □ | □ | |
| 14* | | | | ▩ | ▩ | | ▩ | ▩ | | |
| 13* | | | □ | □ | | | | | ▩ | ▩ |
| 12* | × | | | × | ○ | × | | | × | ○ |
| 11* | □ | □ | | | ▩ | ▩ | | | | |
| 10* | ▩ | | | | | | ▩ | ▩ | | ▩ |
| 9* | | ▩ | ▩ | | | □ | □ | | | |
| 8* | | × | ○ | × | | | × | ○ | × | |
| 7* | | | | □ | □ | | | ▩ | ▩ | |
| 6* | ▩ | | ▩ | ▩ | | | | | | ▩ |
| 5* | | | | | ▩ | ▩ | | | □ | □ |
| 4* | ○ | × | | | × | ○ | × | | | × |
| 3* | ▩ | ▩ | | | | | □ | □ | | |
| 2* | | | ▩ | ▩ | | ▩ | ▩ | | | |
| 1* | | □ | □ | | | | | ▩ | ▩ | |

FIG. 4

| | 1 | 2 | 3 | 4 | 5 | 6 | 7 | 8 |
|---|---|---|---|---|---|---|---|---|
| 32* | × | | × | ○ | × | | × | ○ |
| 31* | ▩ | | | | □ | | | ▩ |
| 30* | | ▩ | ▩ | | | ▩ | ▩ | |
| 29* | □ | | | ▩ | ▩ | | | |
| 28* | | × | ○ | × | | × | ○ | × |
| 27* | | | | □ | | | ▩ | ▩ |
| 26* | ▩ | ▩ | | | ▩ | ▩ | | |
| 25* | | | ▩ | ▩ | | | | □ |
| 24* | × | ○ | × | | × | ○ | × | |
| 23* | | | □ | | | ▩ | ▩ | |
| 22* | ▩ | | | ▩ | ▩ | | | ▩ |
| 21* | | ▩ | ▩ | | | | □ | |
| 20* | ○ | × | | × | ○ | × | | × |
| 19* | | □ | | | ▩ | ▩ | | |
| 18* | | | ▩ | ▩ | | | ▩ | ▩ |
| 17* | ▩ | ▩ | | | | □ | | |
| 16* | × | | × | ○ | × | | × | ○ |
| 15* | □ | | | ▩ | ▩ | | | |
| 14* | | ▩ | ▩ | | | ▩ | ▩ | |
| 13* | ▩ | | | | □ | | | ▩ |
| 12* | | × | ○ | × | | × | ○ | × |
| 11* | | | ▩ | ▩ | | | | □ |
| 10* | ▩ | ▩ | | | ▩ | ▩ | | |
| 9* | | | | □ | | | ▩ | ▩ |
| 8* | × | ○ | × | | × | ○ | × | |
| 7* | | ▩ | ▩ | | | | □ | |
| 6* | ▩ | | | ▩ | ▩ | | | ▩ |
| 5* | | | □ | | | ▩ | ▩ | |
| 4* | ○ | × | | × | ○ | × | | × |
| 3* | ▩ | ▩ | | | | □ | | |
| 2* | | | ▩ | ▩ | | | ▩ | ▩ |
| 1* | | □ | | | ▩ | ▩ | | |

FIG. 5

INDUSTRIAL FABRIC

BACKGROUND OF THE INVENTION

1. Field of the Invention

The present invention relates to an industrial fabric such as a papermaker's fabric, a fabric for producing nonwoven fabric, a fabric used for the removal or squeezing of water from sludge or the like, a belt for producing a constructional material or conveyor belt and, particularly, to a papermaker's fabric, more particularly, to a papermaker's forming fabric.

2. Description of Related Art

Conventionally used industrial fabrics include papermaker's fabrics, such as papermaker's forming fabrics and papermaker's canvasses, fabrics for producing nonwoven fabric, fabrics for removing water from sludge and the like, belts for producing construction materials, conveyor belts, and many others. Dimensional stability is required for these industrial fabrics to prevent elongation or shrinkage in a width direction because when in use, the fabrics are running while they receive tensile force in a warp direction. Running stability and attitude stability (or non-changeability in shape) are also required for these fabrics to prevent zigzag running or wrinkling.

Abrasion resistance is further required because the fabrics contact a driving roll or the like and can be worn away while they are running. Further, as they carry or process an object installed on their surfaces, their surfaces must be smooth.

The above problems are common to industrial fabrics but are yet to be solved.

Papermaker's fabrics are often the most necessarily required to have these properties, as compared to other industrial fabrics. Particularly, papermaker's forming fabrics must have properties for paper making which will be described hereinafter, in addition to the above properties. When a papermaker's forming fabric is described, most problems which are common to industrial fabrics and solutions to these can be described and understood. Therefore, the present invention will be described hereinafter, using a papermaker's forming fabric as a typical example. However, the present invention relates to any type of fabric, and is not limited to papermaker's forming fabric.

A paper making method is a known technology, in which a paper making raw material including pulp fibers or the like is first supplied onto a running papermaker's forming fabric which is formed endless from a head box and laid between rolls of a paper making machine.

A side to which the raw material is supplied to the papermaker's forming fabric is known as a paper making surface and the opposite side is known as a running surface.

The supplied raw material is transferred along with the running of the papermaker's forming fabric, and water is removed from the raw material by a dehydrator such as a suction box or foil installed on the running side of the fabric while it is transferred, thereby forming a wet web. That is, the papermaker's forming fabric functions as a type of filter and separates pulp fibers from water.

The wet web formed in this paper making zone is transferred to a press zone and a drier zone. In the press zone, the wet web is transferred to a papermaker's felt and then carried so that water is squeezed out from the wet web at a nip pressure between press rolls together with the papermaker's felt and further removed. In the drier zone, the wet web is transferred to a papermaker's canvass, carried and dried to make paper.

The papermaker's fabric is woven of warps and wefts such as synthetic resin monofilament yarn by a loom. An endless fabric is formed by known seaming, pin seaming or the like or with a hollow weaving machine in a weaving stage.

In the case of hollow weave, the relationship between warps and wefts is reversed in the loom and at the time of use.

In this specification, the term "warp" means a yarn extending in the mechanical direction of a paper making machine, that is, a running direction of a fabric and the term "weft" mans a yarn extending in the crosswise direction of the paper making machine, that is, a width direction of the fabric.

There are many requirements for a papermaker's fabric, particularly a papermaker's forming fabric. The requirements include the improvement of surface smoothness, the prevention of the formation of wire marks on paper, the improvement of retention, high water filtration properties, abrasion resistance, dimensional stability, running stability, and the like.

In recent years, solutions to the above requirements have been strongly desired, along with desires to increase paper making speed, the paper making of neutralized paper and the consumption of a filler, and a desire to follow a cost reduction policy adopted by paper making companies.

When the paper making speed is increased, the dehydration speed is inevitably accelerated and dehydration force becomes powerful. Since a raw material for paper making is dehydrated through a papermaker's forming fabric, water is removed through meshes formed between the yarns of the papermaker's forming fabric. This mesh space is water filtration space. However, since not only water but also fine fibers, a filler and the like are removed from the raw material for paper making, the yield of produced paper is lower. As the wet web formed on the fabric is pressed against the paper making surface of the fabric by dehydration force, a yarn bites into the wet web in a portion where it is existent and conversely, the wet web bites into space between meshes where no yarn is existent, whereby there is a strong tendency toward the formation of yarn and mesh mark on the surface of the wet web.

Since the density of fibers is excessively increased by the long residence of fibers between meshes, the density of fibers on the paper becomes uneven and the thickness of paper becomes nonuniform. This is called "wire mark" or "water filtration mark".

If the bite of the fabric into the wet web is large or the sticking of fibers occurs, the releasability of the wet web deteriorates when the wet web is transferred to the felt. Although it is impossible to eliminate the wire marks completely, the paper making surface of the fabric must be made fine and fiber supporting properties and smoothness must be improved to minimize them and prevent them from standing out.

If the dehydration speed is high and the dehydration force is powerful, the removal of fibers and the formation of wire marks become marked, thereby making it necessary to further improve the above properties.

Since fibers are aligned in a running direction of the fabric, the fiber supporting properties of wefts in particular must be improved.

Excellent water filtration properties are required to remove water efficiently at a high speed. If the water filtration properties are excellent, it is possible to reduce the vacuum pressure of dehydration, suppress the above-described bite of fibers into space between meshes and the removal of the fibers, eliminate the formation of wire marks, and improve the yield.

If the paper making speed is high, water contained in the fabric is scattered by the centrifugal force of the rotation unit of a roll or the like to form sprays of water which fall on the wet web to form marks. Therefore, the water retention properties of the fabric must be reduced.

Meanwhile, the requirement for the improvement of abrasion resistance is made stronger by the growth of paper making of neutralized paper. Since calcium carbonate is used as a filler in the paper making of neutralized paper, it greatly wears away a yarn on the running surface, unlike clay used in acidic paper making. Further, excessive water filtration caused by an increase in paper making speed or a reduction in water filtration due to the residence of fibers makes conditions more severe.

To improve abrasion resistance, the structure of the fabric is made a weft abrasion type structure, or the material of yarn is changed.

Generally speaking, with a view to improving the abrasion resistance and maintaining the attitude stability of a fabric in use, it is preferred to provide the wefts of the fabric with an abrasion resisting function. If warps wear away, the fabric stretches and wears away due to a reduction in its tensile strength as a matter of course. If the warps further wear away and break, the fabric itself breaks and its service life ends. Therefore, the abrasion of the warps is prevented by the wefts.

An attempt has been made to use polyamide monofilament yarn having excellent abrasion resistance as a weft. However, this attempt does not improve the structure of the obtained fabric itself but makes use of the properties of a material used. Therefore, a remarkable effect cannot be obtained and there is such a defect that the attitude stability of the fabric is poor because the polyamide monofilament has small rigidity.

An attempt has also been made to use thick yarn as a weft on the running surface. However, this involves such a defect that the balance between warps and wefts is lost with the result of deterioration in crimping properties and the formation of wire marks and has a problem to be solved for practical application.

To prevent the formation of wire marks on paper, it is conceivable to increase the numbers of warps and wefts so as to improve fiber supporting properties. To this end, the line diameters of a warp and a weft must be reduced.

However, a known dual layer fabric having an upper layer of weft yarns and a lower layer of weft yarns weaving with a single layer of warp yarns, which is generally used now, deteriorates in abrasion resistance, rigidity and attitude stability when the line diameters of a warp and a weft are reduced.

In this way, when the line diameters are increased to improve abrasion resistance and rigidity, the surface properties of a papermaker's fabric are impaired and wire marks are formed on paper. On the other hand, when the line diameters are reduced and the numbers of warps and wefts are increased to improve surface properties, abrasion resistance and rigidity deteriorate. Therefore, the above properties conflict with one another.

The above abrasion resistance and attitude stability problems are common to all industrial fabrics which have no ends and rotate.

To solve the above problems, an attempt has been made to produce a fabric formed by using different warps and wefts for the paper making side and the running side thereof and integrating both layer fabrics with binder yarn. That is, warps and wefts having small line diameters are used to form a fine paper making surface of a fabric on the paper making side, and warps and wefts having large line diameters are used to form a running surface having large abrasion resistance of a fabric on the running side.

However, this has not always been satisfactory because, in a connection portion where a binder yarn and a yarn on the paper making side cross each other, a depression is formed on the surface of the fabric on the paper making side as the binder yarn pulls the fabric on the paper making side toward the running side and the depression mark is transferred to paper is made actually, thereby forming a wire mark.

When the line diameter of the binder yarn is reduced or the number of the binder yarn is reduced to eliminate the depression as much as possible, the connection force is weakened, whereby the binder yarn is wrinkled between the fabric on the paper making side and the fabric on the running side, thereby causing internal friction. As a result, the binder yarn breaks or stretches and further connecting force is weakened, whereby a gap is formed between the fabric on the paper making side and the fabric on the running side, these fabrics are separated from each other, and hence, the service life of the obtained fabric ends in a short period of time.

To improve fiber supporting properties efficiently and make high-quality paper without forming wire marks on paper, pulp fibers must be suitably supported by wefts. This is because the pulp fibers which are supplied onto the papermaker's forming fabric from the head box are generally aligned in a mechanical direction, that is, a warp direction. It is possible to prevent fibers from staying between warps by dividing a depression between warps by wefts and supporting fibers.

However, this does not mean that the paper making surface may be formed with wefts alone. A fabric must have a portion where a warp is located above a weft and the warp and the weft form the same plane, thereby making it possible to form a smooth paper making surface having no wire mark. It is necessary to improve the fiber supporting properties of wefts while the same plane is formed.

The requirement for the improvement of rigidity, particularly rigidity is a width direction, is becoming important as the paper making speed increases, a tendency toward instantaneous dehydration becomes more marked, and conditions for papermaker's forming fabrics become more severe year after year.

When rigidity in the width direction is low, a wavy wrinkle is formed during running and paper gathers more in a depression portion of the wrinkle than in a projection portion, paper of the depression portion becomes thick and heavy as a matter of course, and paper of the projection portion becomes thin and light, thus producing unevenness in weight in the width direction, that is, a so-called BD failure.

SUMMARY OF THE INVENTION

In view of the above problems, it is an object of the present invention to provide an industrial fabric, particularly a papermaker's fabric, formed by using different warps and wefts to form a surface side and a running side and integrating both layer fabrics with binder yarn, wherein there is no depression on the surface of an upper layer fabric where the binder yarn and yarn on the paper making side cross one another, the warps and the wefts form the same plane, there are many support points, the surface smoothness is high, and the supporting properties of the wefts are improved.

The industrial single-layer or double-layer structured fabric of the present invention has such excellent effects that there is no depression on the surface of an upper layer fabric in a portion where a binder yarn and an upper layer yarn cross each other, warps, wefts, auxiliary wefts and binder yarn form the same plane, thereby making a smooth paper making surface, the fiber supporting properties of wefts are extremely high, smooth paper having no wire marks can be produced, bonding strength is high and well retained, and paper making speed is high.

In accordance with the present invention, there has been provided an industrial double-layer structured fabric comprising:

an upper layer fabric woven of upper layer warps and upper layer wefts, a lower layer fabric woven of lower layer warps and lower layer wefts, binder yarns that connect the upper layer fabric and the lower layer fabric, and an auxiliary weft that passes over two or more adjacent upper layer warps and that is arranged between upper layer wefts, to form a paper making surface, wherein the binders yarns comprise a first and second binder yarn that are respectively arranged on either side of the auxiliary weft, wherein the first binder yarn passes over two or more adjacent upper layer warps to form a paper making surface, and is located above an upper layer warp in a portion of the double-layered structured fabric where the auxiliary weft is located below the same upper layer warp, and wherein a second binder yarn passes over two or more adjacent upper layer warps to form a paper making surface, and is located above an upper layer warp in a portion of the double layered structured fabric where the auxiliary weft is located below the same upper layer warp, and the second binder yarn passes below a lower layer warp in a portion of the double layered structured fabric where the first binder yarn is located above an upper layer warp and forms a paper making surface, and is located above an upper layer warp in a portion of the double-layered structured fabric where the first binder yarn is located below a lower layer warp.

In accordance with the present invention, there has also been provided an industrial single-layer structured fabric formed of woven warps and wefts comprising:

a first auxiliary weft which passes over two or more adjacent warps and is arranged between wefts, at least two second auxiliary wefts, at least one arranged on either side of the first auxiliary weft, wherein the second auxiliary wefts individually pass over two or more adjacent warps and are independently located above a warp in a portion of the structured fabric where the first auxiliary weft is located below the warp, wherein one of the secondary auxiliary wefts passes below warps in a portion where the other secondary auxiliary weft is located above the warps to form a paper making surface, and is located above a warp in portion where the other secondary auxiliary weft is located below the warp.

Further objects, features, and advantages of the invention will become apparent from the detailed description that follows.

BRIEF DESCRIPTION OF THE DRAWINGS

FIG. 4: This is a design diagram showing the structure of Example 2 of the present invention.

FIG. 5: This is a design diagram showing the structure of Example 3 of the present invention.

DETAILED DESCRIPTION OF THE PREFERRED EMBODIMENTS

Figure 1:
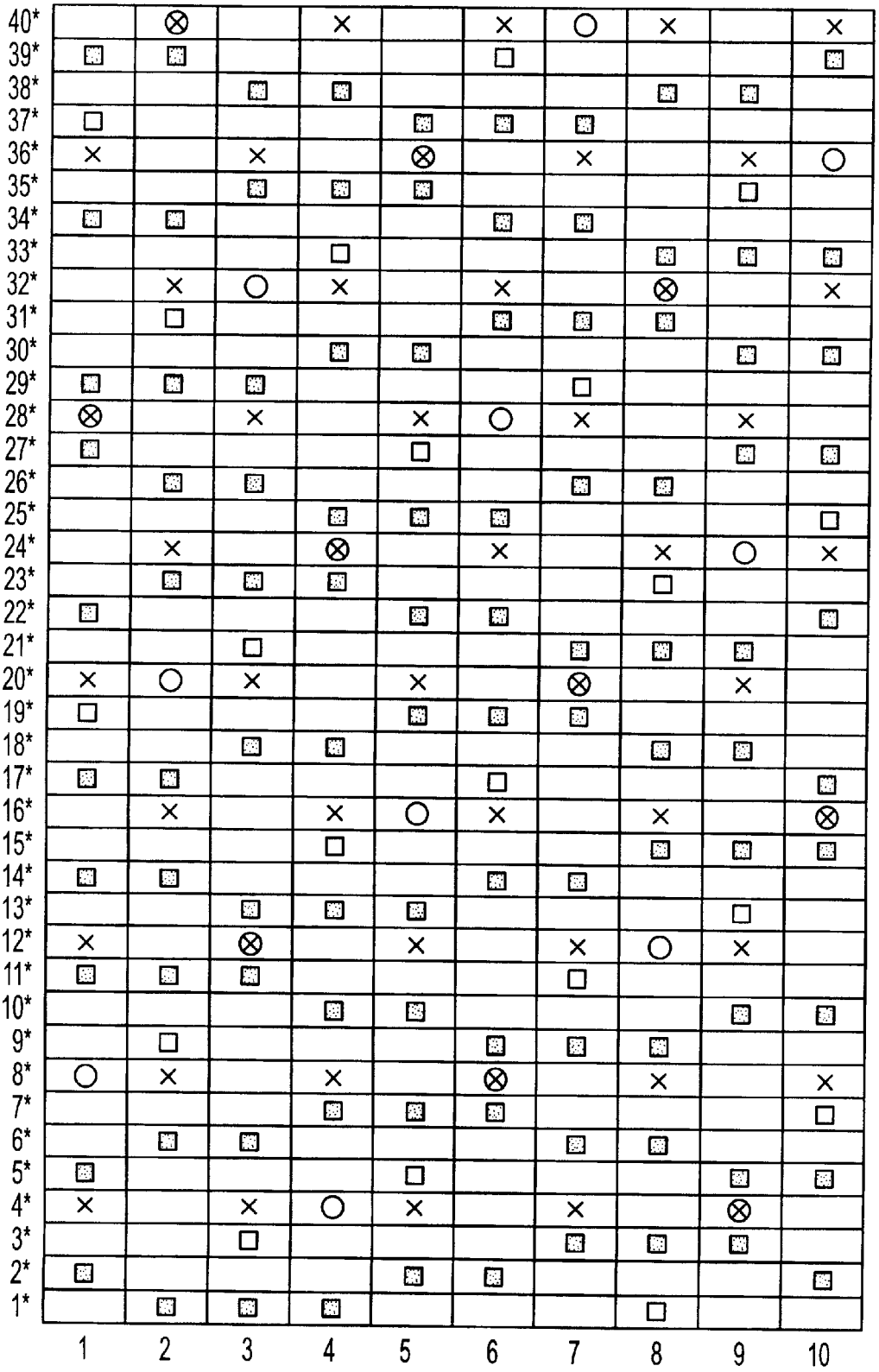
FIG. 1: This is a design diagram showing the structure of Example 1 of the present invention.

An important feature of the present invention is that an auxiliary weft which passes over two or more successive upper layer warps to form a paper making surface is arranged between the upper layer wefts of an upper layer fabric, binder yarn which pass over two or more successive upper layer warps to form a paper making surface and connect the upper layer fabric and a lower layer fabric are arranged on both sides of this auxiliary weft, respectively, and one of the binder yarn goes down and is located below a lower layer warp in a portion where the other binder yarn is located above upper layer warps to form a paper making surface and is located above an upper layer warp in a portion where the other binder yarn is located below the lower layer warp.

Since the auxiliary weft located between upper layer wefts pass over two or more successive upper layer warps and is woven in to form a paper making surface, it contributes to the improvement of the fiber supporting properties of the wefts and further to the improvement of rigidity in a width direction.

Since the auxiliary weft and the binder yarn arranged on both sides of the auxiliary weft are located as described above, these three yarns pass over the upper layer warps alternately to form a paper making surface, and fiber supporting properties can be improved uniformly in a whole width direction.

Since the binder yarn pulls down the upper layer warps directly and the auxiliary weft is woven into the structure to pull down the upper layer warps, the upper layer fabric can be pulled down uniformly in a whole width direction. Thus, the whole structure is pulled down uniformly.

Therefore, unlike the binder yarn of the prior art which passes over one upper layer warp for every several upper layer warps and connects every several recurring units, the binder yarn of the present invention does not form a worm-eaten-like depression on the paper making surface.

Since connecting force is large because two binder yarns are arranged between upper layer wefts and adhesion between the upper layer fabric and the lower layer fabric is high, there can be eliminated problems including that the binder yarn are crumpled between these fabrics and internal abrasion occurs with the result of a reduction in connecting force, a gap is formed between the fabrics, and the fabrics are separated from each other.

If the auxiliary weft and the structure of the binder yarn are such as described above, other structures of the fabric can be selected as desired. However, when the auxiliary weft passes over two successive upper layer warps to form a paper making surface and passes below three upper layer warps to be woven in and the binder yarn passes over three upper layer warps below which the auxiliary weft passes, the auxiliary weft and the binder yarn can be located above all the upper layer warps, and fiber supporting properties can be improved uniformly in a whole width direction.

That is, the auxiliary weft forms a crimp as long as two upper layer warps on the paper making side, and the binder yarn forms crimps as long as three upper layer warps.

The paper making surfaces formed by the auxiliary weft and the binder yarn can be made flush with one another, and substantial fiber supporting efficiency can be made the highest.

The term "crimp" refers to a yarn portion projecting on the paper making side or the running side between knuckles. The term "knuckle" refers to a portion where a warp and a weft cross each other.

Naturally, a crimp formed by a yarn is not formed straight in a horizontal direction but projects like an arc. The amount of projection is larger as the length of the crimp increases.

Therefore, it seems more difficult to form the same plane with a crimp as long as three upper layer warps than a crimp as long as two upper layer warps because the crimp as long as three upper layer warps projects more than the crimp as long as two upper layer warps. By causing the binder yarn to form a crimp as long as three upper layer warps, the crimp is pulled down more and can be made flush with the crimp as long as two upper layer warps.

When the binder yarn is caused to pass over three upper layer warps, pass between the subsequent three upper layer warps and three lower layer warps, pass below the next one lower layer warp and then pass between three upper layer warps and three lower layer warps, its structure is bisymmetric about a crimp portion which forms a paper making surface when it passes over three upper layer warps, and a paper making surface is formed bisymmetrically uniformly and efficiently without projecting or depressing one side of the crimp, thereby ensuring high smoothness advantageously.

When the binder yarn is caused to pass over three upper layer warps, pass between the subsequent three upper layer warps and three lower layer warps, pass below the next two lower layer warps and then pass between two upper layer warps and two lower layer warps, the positions of weaving in the binder yarn and the lower layer warps hardly shift, thereby stabilizing weaving properties advantageously. As for details, examples of the present invention will be described with reference to the accompanying drawings.

The structure of the upper layer fabric is not particularly limited but a plain weave structure is suitable.

Since the plain weave structure is such that warps and wefts are woven alternately one by one, the number of fiber supporting points is the largest, surface smoothness is high, and rigidity in an oblique direction is high because the number of times of weaving in is large.

A smooth paper making surface having a large number of fiber supporting points is formed in the upper layer fabric, and fiber supporting properties in a weft direction are improved by the auxiliary wefts and the binder yarn.

There are the following structures besides the plain weave structure. They include a 4-shaft fabric formed by shifting upper layer warps which pass over two successive upper layer wefts and pass under two successive upper layer wefts by one upper layer weft sequentially, a 5-shaft fabric formed by shifting upper layer warps which pass over two successive upper layer wefts and pass under three successive upper layer wefts by three upper layer wefts sequentially, and the like.

The structure of the above 4-shaft fabric has well balanced crimps because both upper layer warps and upper layer wefts form only crimps as long as two upper layer wefts and two upper layer warps, respectively, high smoothness and the high fiber supporting properties of wefts because the distance of a crimp formed by each weft on the paper making surface is long though the number of fiber supporting points is smaller than that of a plain weave structure. The structure of the above 5-shaft fabric is free from the formation of wire marks because a long groove is not formed in a warp direction between upper layer warps due to lack of adjacent crimp portions of an upper layer warp between adjacent warps and the high fiber supporting properties of the upper layer wefts.

As a matter of course, 3-shaft fabric, 6-shaft fabric and the like may be used in addition to these.

The lower layer fabric can be selected as desired, but it is suitably of a weft abrasion type structure so as to provide abrasion resistance. The number of yarns for the upper layer fabric is not particularly limited, and the number of the lower layer warps or the number of the lower layer wefts may be ½ or ⅔ that of the upper layer warps or that of the upper layer wefts, respectively.

However, the density of the lower layer wefts which is related to abrasion resistance is most suitably the same as the density of the upper layer fabric. If the density is too low, abrasion resistance is disadvantageously reduced.

The yarn used in the present invention can be selected freely according to properties which are required for a fabric and is not particularly limited. Any desired yarn can be used. For example, multi-filament yarn, spun yarn, processed yarn called generally textured yarn, bulky yarn or stretched yarn which is subjected to crimping or bulking, chenille yarn and yarn produced by combining these may be used in addition to monofilament yarn. Yarn having a circular, square, star-shaped, rectangular, flat or oval cross section, or hollow yarn may be used.

The material of the yarn can be freely selected as desired, for example, from polyester, nylon, polyphenylene sulfide, polyvinylidene polypropylene fluoride, aramide, polyether ether ketone, polyethylene naphthalate, wool, cotton, metals, and the like. Also, yarn formed by copolymerizing or blending various materials with these materials may be used according to application purpose.

Generally, polyester monofilament yarn having rigidity and excellent dimensional stability is preferably used for the upper layer warps, the lower layer warps and the upper layer wefts, and nylon monofilament yarn is preferably used for the auxiliary wefts and the binder yarn which are required to have a small line diameter as well as shower resistance, fibrillation resistance, and internal abrasion resistance.

When seaming properties are taken into consideration polyester monofilament yarn having high shape stability is preferably used for the binder yarn.

Polyester monofilament yarn and nylon monofilament yarn are preferably woven alternately as the lower layer wefts which are required to have abrasion resistance to improve abrasion resistance while ensuring rigidity.

The line diameter of the yarn can be freely selected according to properties required for a papermaker's fabric, such as a mesh and the like and is not particularly limited. However, the line diameter of the auxiliary weft and the line diameter of the binder yarn are preferably 60 to 90% of the line diameter of the upper layer weft from the view point of surface properties and the like.

Several yarns may be paralleled and used in such a structure that a single yarn is to be used originally. Surface properties can be improved and the thickness of a fabric can be reduced by paralleling several yarns having a small line diameter.

EXAMPLES

The following examples are given to further illustrate the present invention, but do not limit the invention.

FIGS. 1, 4, 5 and 6 are design diagrams showing the complete design of the examples of the present invention.

The complete design is the minimum recurring unit of a fabric structure and the whole structure of a fabric is formed by connecting these structures in horizontal and vertical directions.

Figure 2:
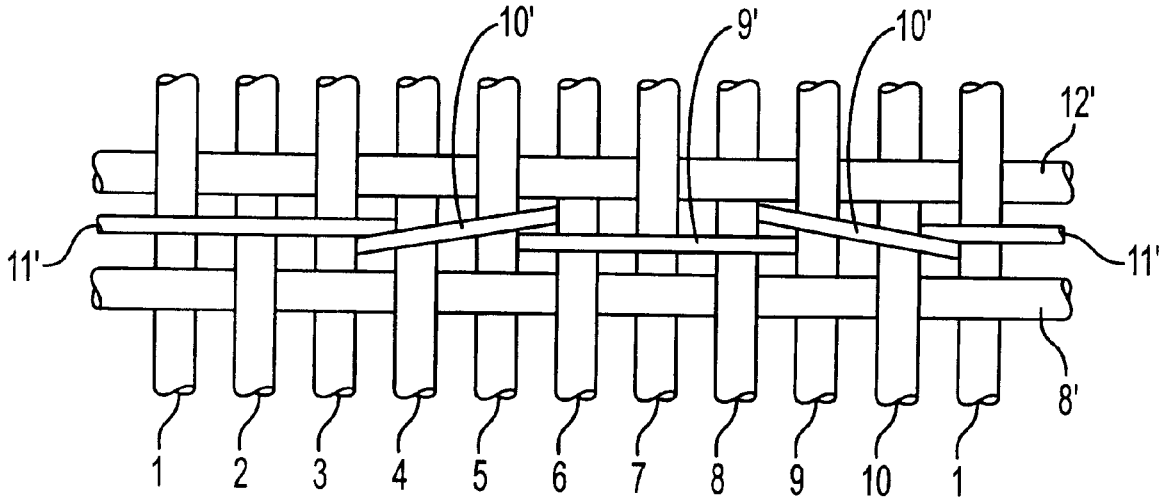
FIG. 2: This is a partial plan view of the Example shown in FIG. 1.
Figure 3:
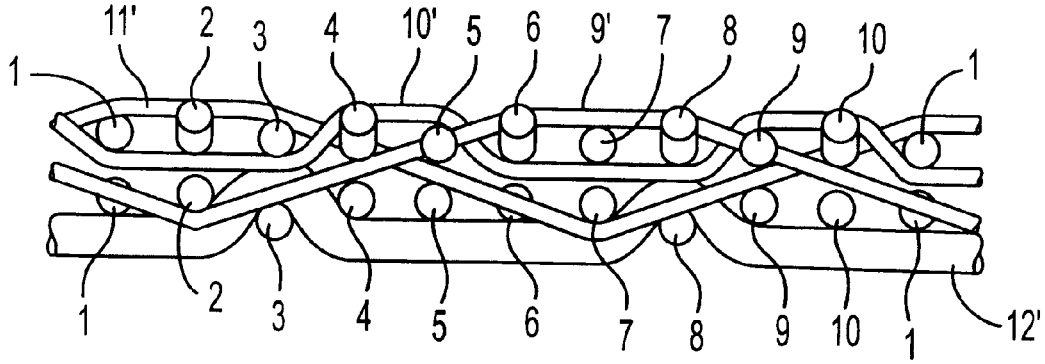
FIG. 3: This is a sectional view along a weft of Example shown in FIG. 1.

FIG. 2 is a partial plan view of the paper making side of the example of FIG. 1 and FIG. 3 is a sectional view along the wefts of the example.

In the design diagrams, warps are denoted by Arabic numerals, for example, 1, 2 and 3, and wefts are denoted by Arabic numerals with an apostrophe, for example, 1', 2' and 3'.

A mark x indicates that an upper layer warp is located above or over an upper layer weft, a mark O indicates that a lower layer warp is located below or under a lower layer weft, a mark ■ indicates that an auxiliary weft and a binder yarn are located above an upper layer warp and a mark □ indicates that a binder yarn is located below a lower layer warp. A mark ⓧ indicates the location where an upper layer warp is disposed over an upper layer weft and a lower layer warp is disposed under a lower layer weft.

Upper layer and lower layer warps and wefts are overlapped with one another. Since the densities of the upper layer and lower layer warps and wefts are the same in the following examples, the lower layer warps and wefts are located right below the upper layer warps and wefts.

In the design diagrams, yarns are precisely overlapped with one another in a vertical direction such that the lower layer warps and wefts are located right below the upper layer warps and wefts. They are illustrated as described above according to the conditions of the drawings and may be shifted in an actual fabric.

In fact, the structure of the binder yarn is made asymmetric (the inclination angles of the binder yarn which extend from above an upper layer warp to below a lower layer warp on right and left sides are made different) to shift the overlapping upper layer and lower layer warps and wefts intentionally in order to improve adhesion between the upper layer fabric and the lower layer fabric for the improvement of rigidity and reduce the thickness of the fabric.

While a double-layer structured fabric is primarily discussed above, a single layer structured fabric can be made analogously to the double-layer structure discussed above and exemplified below.

Example 1

FIG. 1 is a design diagram showing the complete design (or the repeating unit) of Example 1 of the present invention, FIG. 2 is a plan view of a paper making surface as part of the complete design, and FIG. 3 is a sectional view along a weft. In FIG. 3, upper layer wefts 11' and 12' shown in FIG. 2 are omitted to avoid complexity.

In the design diagram of FIG. 1; 1, 2, 3, 4, 5, 6, 7, 8, 9 and 10 denote warps, and upper layer warps and lower layer warps are overlapped with one another in a vertical direction and denoted by the above numbers. 4', 8', 12', 16', 20', 24', 28', 32', 36' and 40' denote wefts, and upper layer wefts and lower layer wefts are overlapped with one another in a vertical direction and denoted by the above numbers.

2', 6', 10', 14', 18', 22', 26', 30', 34' and 38' represent auxiliary wefts, and 1', 3', 5', 7', 9', 11', 13', 15', 17', 19', 21', 23', 25', 27', 29', 31', 33', 35', 37' and 39' represent binder yarn.

It is understood from the design diagram that an upper layer fabric has a plain weave structure and that one upper layer warp and one upper layer weft are interwoven alternately in a vertical direction. Since the plain weave structure is constituted as described above, the number of fiber supporting points is the largest and a paper making surface having high smoothness can be obtained. It is also understood that a lower fabric is of a weft abrasion type that a crimp as long as four lower layer warps is formed on a running side thereof to prevent the abrasion of warps and has excellent abrasion resistance.

Looking at the auxiliary wefts, the auxiliary weft 10', for example, passes between the upper layer warps 1, 2 and 3 and the lower layer warps 1, 2 and 3, passes over the upper layer warps 4 and 5, passes between the upper layer warps 6, 7 and 8 and the lower layer warps 6, 7 and 8 and then passes over the upper layer warps 9 and 10. In other words, it is understood that the auxiliary weft 10' passes over two upper layer warps to form a paper making surface and then passes under three upper layer warps repeatedly. Since it passes over two adjacent upper layer warps to form a crimp and a paper making surface, the fiber supporting properties of the wefts are improved.

The binder yarn 9' and 11' are arranged on both sides of this auxiliary weft 10', respectively. The connecting yarn 9' passes between the upper layer warp 1 and the lower layer warp 1, passes under the lower layer warp 2 to be woven with the lower layer fabric, passes between the upper layer warps 3, 4 and 5 and the lower layer warps 3, 4 and 5, passes over the upper layer warps 6, 7 and 8 and then passes between the upper layer warps 9 and 10 and the lower layer warps 9 and 10. The binder yarn 11' passes over the upper layer warps 1, 2 and 3, passes between the upper layer warps 4, 5 and 6 and the lower layer warps 4, 5 and 6 passes under the lower layer warp 7 to be woven with the lower layer fabric and then passes between the upper layer warps 8, 9 and 10 and the lower layer warps 8, 9 and 10.

As both of the binder yarns pass over adjacent three upper layer warps to form a crimp and a paper making surface, the fiber supporting properties of the wefts are improved.

Further, both of the binder yarn pass over upper layer warps (1, 2, 3, 6, 7 and 8) other than the upper layer warps (4, 5, 9 and 10) over which the auxiliary weft passes to form the paper making surface so as to form the paper making surface.

The two binder yarns pass over different upper layer warps. One of the binder yarns goes down and is located below a lower layer warp in a portion where the other binder yarn is located above upper layer warps to form the paper making surface and located above an upper layer warp in a portion where the other binder yarn is located below the lower layer warp.

Therefore, three yarns in total—the auxiliary weft and the binder yarn—pass over the upper layer warps alternately to form the paper making surface, thereby making it possible to improve fiber supporting properties uniformly in a whole width direction.

Further, since these yarns pass over all the upper layer warps to form the paper making surface in this example, the fiber supporting properties can be improved most efficiently.

It is well understood from the plan view of FIG. 2 that the upper layer warps and the upper layer wefts are interwoven in a plain manner to form a paper making surface having a large number of fiber supporting points, the auxiliary weft and the binder yarn are located between the adjacent upper layer wefts, any one of the yarn passes over all the upper layer warps to form crimps, and a paper making surface having the high fiber supporting properties of the wefts is formed.

It is also understood from the sectional view along the weft of FIG. 3 that the auxiliary weft 10', the binder yarn 9' and the binder yarn 11' appear on the paper making surface alternately to form the same plane, and the binder yarn 9' passing under the lower layer warp 2 and the binder yarn 11' passing under the lower layer warp 7 are interwoven and function as binder yarn.

It is further understood that the lower layer weft 12' forms crimps on the running side to protect the lower layer warps from being worn away.

The upper layer weft 12' is not shown to avoid a complicated drawing.

The upper layer warps 6, 7 and 8 and the upper layer warps 1, 2 and 3 in a portion where the binder yarn passes over these warps to form crimps are pulled down directly by the binder yarn 9' and the binder yarn 11', respectively. It is seen that the upper layer warps 4 and 5 and the upper layer warps 9 and 10 in a portion where the auxiliary weft 10' passes over these warps to form crimps are pulled down indirectly by the auxiliary weft 10' located below the upper layer warps 6, 7 and 8 and the upper layer warps 1, 2 and 3 which is pulled down because the upper layer warps 6, 7 and 8 and the upper layer warps 1, 2 and 3 are pulled down by the binder yarn 9' and the binder yarn 11' respectively.

Therefore, the upper layer fabric can be pulled down uniformly in a whole width direction.

As for the strength of pulling the upper layer warps, the pull strength of the binder yarn which pulls directly is larger and hence, the binder yarn sinks deeper. However, since the length of the crimp of the binder yarn is as long as three auxiliary wefts and not two auxiliary wefts in this example, if the pull strength is the same, the binder yarn having a longer crimp projects. However, since the pull strength of the binder yarn is large, the crimps of both binder yarns can be formed on the same plane.

The structures of these binder yarns are the same, that is, the distance between a position where a crimp is formed on the paper making side and a position where the connecting yarn passes under the lower layer warp is as long as three warps (for example, three warps 4, 5 and 6 and three warps 8, 9 and 10 in the case of the binder yarn 11') and are bisymmetric about the center of the crimp portion. Therefore, one side of the crimp does not project or depress and a paper making surface can be uniformly formed bisymmetrically.

Example 2

FIG. 4 is a design diagram showing the complete design of Example 2 of the present invention.

The relationships between yarns and symbols are the same as those of Example 1. Wefts are denoted by 4', 8', 12', 16', 20', 24', 28', 32', 36' and 40'. Auxiliary wefts are denoted by 2', 6', 10', 14', 18', 22', 26', 30', 34' and 38', and binder yarns are denoted by 1', 3', 5', 7', 9', 11', 13', 15', 17', 19', 21', 23', 25' 27', 29', 31', 33', 35', 37' and 39'.

First looking at an upper layer fabric, it is understood that the upper layer warp 2, for example, passes over two continuous upper layer wefts 4' and 8' and then passes under three continuous upper layer wefts 12', 16', and 20', and that the structure of upper layer wefts is such that an upper layer weft passes over a single upper layer warp 1, passes under a single upper layer warp 2, passes over two upper layer warps 3 and 4 and then passes under a single upper layer warp 5.

An upper layer fabric is formed as described above, and a crimp of an upper layer warp as long as two upper wefts is formed, a crimp of an upper layer weft as long as two upper layer warps and a knuckle as long as one upper layer warp are formed on a paper making side. A crimp of an upper layer warp as long as two upper layer wefts and a crimp of an upper layer weft as long as two upper layer warps form the same plane of the paper making surface, thereby providing a smooth paper making surface. Although the knuckle of an upper layer weft as long as one upper layer warp is depressed slightly because it is shorter than the crimp as long as two upper layer warps and cannot form the above same plane accordingly, it fully contributes to the improvement of the fiber supporting properties of the wefts and the improvement of rigidity as well.

As is seen from the design drawing, this example has no portion where crimp portions of the upper layer warp are adjacent to each other between adjacent warps (for example, the crimp of the upper layer warp 1 is formed in the upper layer wefts 12' and 16' and the crimp of the upper layer warp 2 is formed in the upper layer wefts 4' and 8' and not adjacent to the crimp of the upper layer warp 1) and hence, a groove in a warp direction between the upper layer warps is divided by the wefts and the fiber supporting properties of the upper layer wefts are satisfactory.

Then looking at the auxiliary wefts, the auxiliary weft 18', for example, is arranged above the upper layer warps 1 and 2 and the upper layer warps 4 and 5 to form two crimps as long as two upper layer warps at two respective locations.

The binder yarn 17' and 19' are arranged on both sides of the auxiliary weft 18' respectively, the binder yarn 17' passes over the upper layer warps 6 and 7 to form a crimp and passes under the lower layer warps 10 and 1 to be woven with a lower layer fabric, and the binder yarn 19' passes over the upper layer warps 9 and 10 to form a crimp and passes under the lower layer warps 5 and 6 to be woven with the lower layer fabric.

It is seen that both of the auxiliary weft and the binder yarn form crimps as long as two upper layer warps on the paper making side, the binder yarn is mainly located above an upper layer warp in a portion where the auxiliary weft is mainly located below the upper layer warp and pass over different upper layer warps, and one binder yarn goes down and is located below a lower layer warp in a portion where the other binder yarn is mainly located above upper layer warps to form a paper making surface and is mainly located above an upper layer warp in a portion where the other binder yarn is mainly located below the lower layer warp, and it is understood that fiber supporting properties are improved uniformly in a whole width direction.

Example 3

FIG. 5 is a design diagram showing the complete design of Example 3 of the present invention.

The relationships between yarns and symbols are the same as those of the above examples.

First looking at an upper layer fabric, the structure of the upper layer fabric has the same plain weave structure as in Example 1 and has the largest number of fiber supporting points, and a paper making surface having extremely high smoothness can be obtained.

Then looking at auxiliary wefts, the auxiliary weft 26', for example, is located above the upper layer warps 1 and 2 and the upper layer warps 5 and 6 to form two crimps as long as two upper layer warps at two respective locations.

The binder yarn 25' and 27' are arranged on both sides of the auxiliary weft 26', respectively, the binder yarn 25' passes over the upper layer warps 3 and 4 to form a crimp and passes under the lower layer warp 8 to be woven with a lower layer fabric, and the binder yarn 27' passes over the upper layer warps 7 and 8 to form a crimp and passes under the lower layer warp 4 to be woven with the lower layer fabric. It is seen that both of the auxiliary weft and the binder yarn form crimps as long as two or more upper layer warps on the paper making side, the binder yarn is located above an upper layer warp in a portion where the auxiliary weft is located below the upper layer warp and pass over different upper layer warps, and one binder yarn goes down and is located below a lower layer warp in a portion where the other binder yarn is located above upper layer warps to form a paper making surface and is located above an upper layer warp in a portion where the other binder yarn is located below the lower layer warp, and it is understood that fiber supporting properties are improved uniformly in a whole width direction.

Example 4

Figure 6:
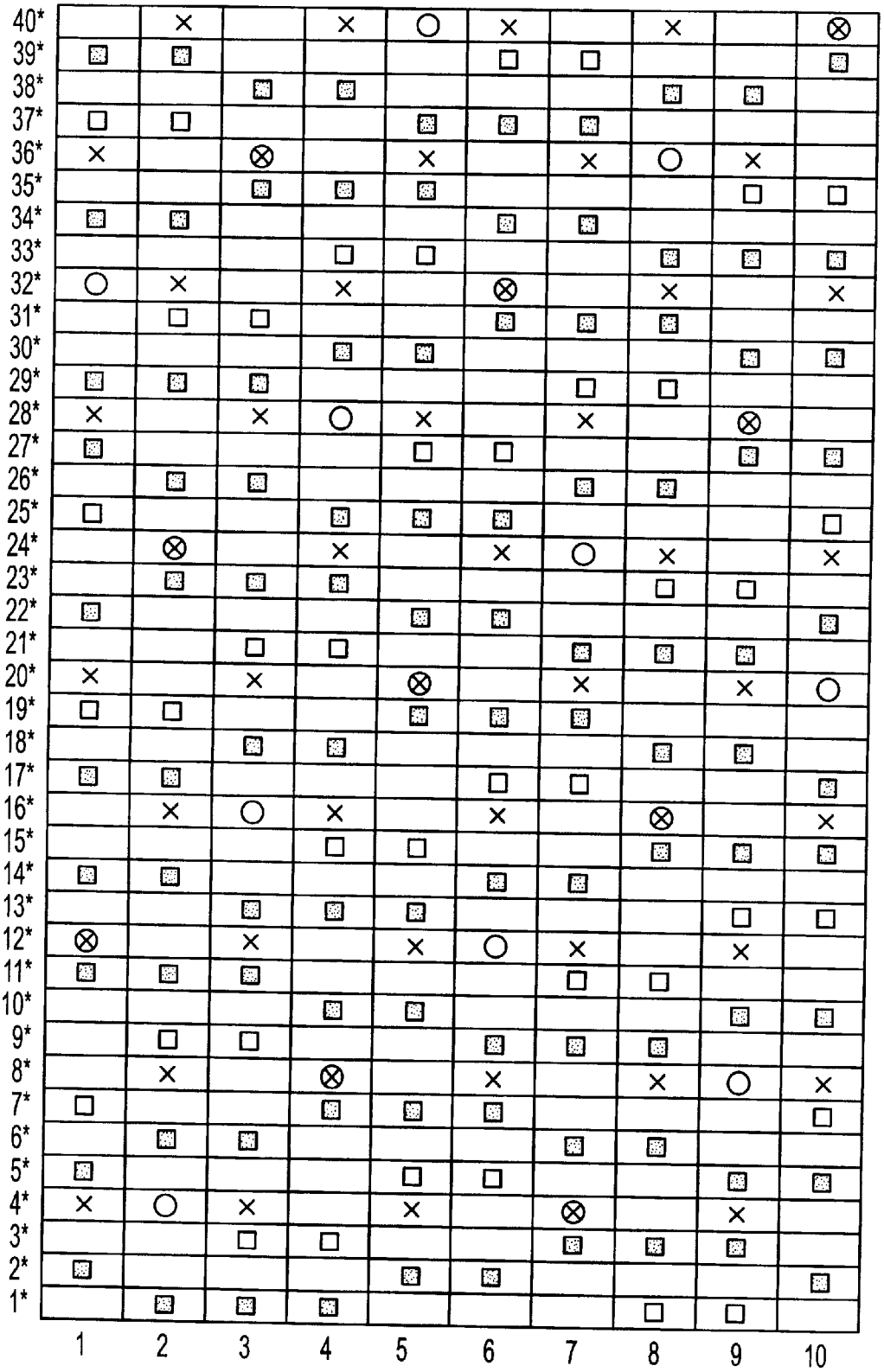
FIG. 6: This is a design diagram showing the structure of Example 4 of the present invention.

FIG. 6 is a design diagram showing the complete design of Example 4 of the present invention.

The relationship between yarns and symbols are the same as in the above examples.

First looking at an upper layer fabric, the structure of the upper layer fabric has the same plain weave structure as in Example 1 and has the largest number of fiber supporting points and a paper making surface having extremely high smoothness can be obtained. Then looking at auxiliary wefts, the auxiliary weft 14', for example, is arranged above the upper layer warps 1 and 2 and the upper layer warps 6 and 7 to form two crimps as long as two upper layer warps at two respective locations. The binder yarn 13' and 15' are arranged on both sides of the auxiliary weft 14', respectively, the binder yarn 13' passes over the upper layer warps 3, 4 and 5 to form a crimp and passes under the lower layer warps 9 and 10 to be woven with a lower layer fabric, and the fiber yarn 15' passes over the upper layer warps 8, 9 and 10 to form a crimp and passes under the lower layer warps 4 and 5 to be woven with the lower layer fabric.

It is seen that both of the auxiliary weft and the binder yarn form crimps as long as two or more upper layer warps on the paper making side, the binder yarn is mainly located above an upper layer warp in a portion where the auxiliary weft is mainly located below the upper layer warp and pass over different upper layer warps and one binder yarn goes down and is located below a lower layer warp in a portion where the other binder yarn is mainly located above upper layer warps to form a paper making surface and is mainly located above an upper layer warp in a portion where the other binder yarn is mainly located below the lower layer warp, and it is understood that fiber supporting properties are improved uniformly in a whole width direction. A so-called border transgression problem that the position of the binder yarn to be interwoven with a lower layer warp is shifted at the time of weaving is eliminated by making the structure of the binder yarn the above structure. The reason for this will be described below.

Looking at the binder yarn 15', for example, it is woven under the lower layer warps 4 and 5. The position where this binder yarn is woven with the lower layer warps is a portion where the warp 4 has been interwoven with the lower layer warp 8' from below and then goes up, the warp 5 goes down to be interwoven with the lower layer warp 20' from below, that is, the warp going up and the warp going down cross each other. In other words, the binder yarn is sandwiched between these warps and fixed at that position and the weaving position is not shifted.

Comparative Example

Figure 7:
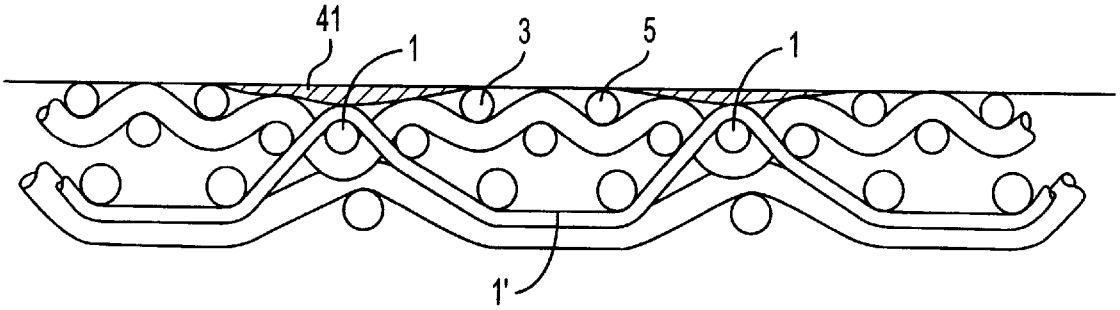
FIG. 7: This is a sectional view along a weft of the prior art.

FIG. 7 is a cross section along a weft showing the complete design of a conventional papermaker's double-layer fabric. The fabric on the paper making side has a plain weave structure.

It is well understood that only the warp 1 on the paper making side is pulled toward the running side by the binder yarn 1' and a depression 41 is formed.

Comparison Test

A test on comparison between the example of the present invention shown in FIG. 1 and the prior art example shown in FIG. 7 is demonstrated to describe the effect of the present invention.

The structures of fabrics and test results are shown in Table 1.

TABLE 1

| | | Example | Prior Art Example |
|---|---|---|---|
| Paper Making Side | | | |
| warp | material | PET | PET |
| | line diameter (mm) | 0.15 | 0.17 |
| | density (per inch) | 75 | 70 |
| weft | material | PET | PET |
| | line diameter | 0.15 | 0.17 |
| | density (per inch) | 45 | 70 |
| auxiliary weft: | material | P.A | |
| | line diameter | 0.11 | |
| | density (per inch) | 45 | |
| Traveling Side | | | |
| warp | material | PET | PET |
| | line diameter | 0.20 | 0.20 |
| | density (per inch) | 75 | 35 |
| weft | material | PET, P.A. | PET, P.A. |
| | line diameter (mm) | 0.28 | 0.30 |
| | Density (per inch) | 45 | 35 |
| connecting thread | material | P.A. | PET |
| | line diameter (mm) | 0.11 | 0.12 |
| | density (per inch) | 90 | 35 |
| sheet smoothness (sec) | | 95 | 68 |
| wire mark | | not seen | seen |
| bonding strength (kg/cm) | | — | 2.3 |

PET = Polyester
PA = Polyamide

The following properties linked in the Table were measured as follows:

sheet smoothness: A paper sheet weighing 70 g/m$^2$ was manufactured from raw material pulp comprising medium-quality paper using a TAPPI standard sheet test machine and a smooth sheet was manufactured in accordance with a commonly used method to measure the smoothness of the paper in contact with a fabric by a Bekk smoothness tester.

wire mark: judged visually.

In the prior art example, paper of a portion depressed by the binder yarn is thick and this thick portion appears as an oblique continuous black line. In the example of the present invention, such a mark is not seen.

bonding strength: A sample having a width of 40 mm and a length of about 300 mm is prepared and only the binder yarn of a portion having a length of 80 mm are cut by a cutter to separate a fabric on the paper making side and a fabric on the running side so as to form a chucked portion. The fabric on the paper making side and the fabric on the running side which have been separated from each other are attached to the chuck of a tensile tester, a load is applied on the fabrics to measure the average strength when the fabrics of an unseparated portion are separated from each other, and the measurement value is calculated in unit of cm.

In the example of the present invention, the bonding strength was too high that the upper layer fabric was broken and could not be measured.

Japanese application 9-293105, filed Sep. 19, 1997 for which priority is claimed under 35 U.S.C. § 119, is hereby incorporated by reference in its entirety.

Other embodiments of the invention will be apparent to those skilled in the art from consideration of the specification and practice of the invention disclosed herein.

What is claimed is:

1. An industrial double-layer structured fabric comprising:

an upper layer fabric woven of upper layer warps and upper layer wefts, a lower layer fabric woven of lower layer warps and lower layer wefts, binder yarns that connects the upper layer fabric and the lower layer fabric, and an auxiliary weft that passes over two or more adjacent upper layer warps and does not pass under the lower layer warps, and that is arranged between upper layer wefts, to form a paper making surface, wherein the binder yarns comprise a first and second binder yarn that are respectively arranged on either side of the auxiliary weft, wherein the first binder yarn passes over two or more adjacent upper layer warps to form a paper making surface, and is located above an upper layer warp in a portion of the double-layered structured fabric where the auxiliary weft is located below the same upper layer warps, and wherein a second binder yarn passes over two or more adjacent upper layer warps to form a paper making surface, and is located above an upper layer warp in a portion of the double layered structured fabric where the auxiliary weft is located below the same upper layer warps, and the second binder yarn passes below a lower layer warp in a portion of the double layered structured fabric where the first binder yarn is located above an upper layer warp and forms a paper making surface, and is located above an upper layer warp in a portion of the double-layered structured fabric where the first binder yarn is located below a lower layer warp.

2. An industrial double-layer structured fabric according to claim 1, wherein the binder yarns are mainly located above an upper layer warp in a portion where the auxiliary weft is mainly located below the upper layer warp.

3. An industrial double-layer structured fabric according to claim 1, wherein the first binder yarn is mainly located below a lower layer warp in a portion where the second binder yarn is mainly located above an upper layer warp to form a paper making surface, and the first binder yarn is mainly located above an upper layer warp in a portion where the second binder yarn is mainly located below the upper layer warp.

4. An industrial double-layer structured fabric according to claim 1, wherein the auxiliary weft passes over two upper layer warps to form a paper making surface and then pass under three upper layer warps repeatedly, and binder yarn passes over three upper layer warps under which the auxiliary weft passes, to form a paper making surface.

5. An industrial double-layer structured fabric according to claim 1, wherein the auxiliary weft passes over two upper layer warps to form a paper making surface and then passes under three upper layer warps repeatedly, and binder yarn passes over three upper layer warps under which the auxiliary weft passes to form a paper making surface, passes between two adjacent upper layer warps and lower layer warps, passes under two adjacent lower layer warps, and then passes between two adjacent upper layer warps and lower layer warps repeatedly.

6. An industrial double-layer structured fabric according to claim 1, wherein the upper layer fabric has a plain weave structure.

7. An industrial single-layer structured fabric formed of woven warps and wefts comprising:

a first auxiliary weft which passes over two or more adjacent warps and is arranged between wefts, at least two second auxiliary wefts, at least one arranged on either side of the first auxiliary weft, wherein the second auxiliary wefts individually pass over two or more adjacent warps and are independently located above a warp in a portion of the structured fabric where the first auxiliary weft is located below the warp, wherein one of the second auxiliary wefts passes below warps in a portion where the other second auxiliary weft is located above the warps to form a paper making surface, and is located above a warp in portion where the other second auxiliary weft is located below the warp.

8. An industrial single-layer structured fabric according to claim 7, wherein the second auxiliary wefts are mainly located above a warp in a portion where the first auxiliary weft is mainly located below the warp.

9. An industrial single-layer structured fabric according to claim 7, wherein one of the second auxiliary wefts is mainly located below warps in a portion where the other secondary auxiliary weft is mainly located above the warps to form a paper making surface, and is mainly located above a warp in a portion where the other second auxiliary weft is mainly located below the warp.

* * * * *